US009399230B2

(12) United States Patent
Wojciechowski, III et al.

(10) Patent No.: US 9,399,230 B2
(45) Date of Patent: Jul. 26, 2016

(54) ROTATING FLUID NOZZLE FOR TUBE CLEANING SYSTEM

(71) Applicant: NLB Corp., Wixom, MI (US)

(72) Inventors: Donald Anthony Wojciechowski, III, Redford, MI (US); Matthew O. Herhold, Fenton, MI (US)

(73) Assignee: NLB CORP., Wixom, MI (US)

( * ) Notice: Subject to any disclaimer, the term of this patent is extended or adjusted under 35 U.S.C. 154(b) by 189 days.

(21) Appl. No.: 14/156,873

(22) Filed: Jan. 16, 2014

(65) Prior Publication Data

US 2015/0196928 A1 Jul. 16, 2015

(51) Int. Cl.

| | |
|---|---|
| ***B05B 1/02*** | (2006.01) |
| ***B05B 3/06*** | (2006.01) |
| ***B05B 13/06*** | (2006.01) |
| ***B08B 9/043*** | (2006.01) |

(52) U.S. Cl.

CPC ..... *B05B 3/06* (2013.01); *B05B 13/0636* (2013.01); *B08B 9/0433* (2013.01)

(58) Field of Classification Search

CPC ..... B05B 1/02; B05B 1/341
USPC ..... 239/252–262
See application file for complete search history.

(56) References Cited

U.S. PATENT DOCUMENTS

| | | | |
|---|---|---|---|
| 1,977,763 | A | 10/1934 | Gordon |
| 3,433,489 | A | 3/1969 | Wiese |
| 3,802,515 | A | 4/1974 | Flamand et al. |
| 3,810,637 | A | 5/1974 | Bonvin |
| 4,114,703 | A | 9/1978 | Matson, Jr. et al. |
| 4,196,911 | A | 4/1980 | Matsushita |
| 4,225,000 | A | 9/1980 | Maurer |

(Continued)

FOREIGN PATENT DOCUMENTS

| | | | |
|---|---|---|---|
| CN | 2152606 | Y | 12/1994 |
| CN | 2587520 | Y | 11/2003 |

(Continued)

OTHER PUBLICATIONS

Kollé, Jack J., A Comparison of Water Jet, Abrasive Jet and Rotary Diamond Drilling in Hard Rock, Presentation for Energy Sources Technology Conference & Exhibition (ETCE'98), Houston, TX, Feb. 2-4, 1998, pp. 1-7.

(Continued)

*Primary Examiner* — Arthur O Hall
*Assistant Examiner* — Viet Le
(74) *Attorney, Agent, or Firm* — Brooks Kushman P.C.

(57) ABSTRACT

A nozzle for use in a high pressure water jetting system is provided including a stationary housing, a rotating shaft, and a central passage within the shaft for communicating high pressure fluid to the nozzle. The shaft may include communication passages to provide fluid from the central passage to a forward fluid pressure chamber defined between an outer peripheral surface of the shaft and the housing. A rear fluid pressure chamber may be defined between the shaft and the housing and a restriction may be defined between the housing and the inlet end of the shaft, the restriction configured to receive fluid from the rear fluid pressure chamber and transport it to a chamber communicating with the atmosphere. The restriction may be formed as an annular gap between the housing and the inlet end of the shaft and configured to decrease in volume when the shaft moves axially forward.

20 Claims, 1 Drawing Sheet

(56) References Cited

U.S. PATENT DOCUMENTS

| | | | | |
|---|---|---|---|---|
| 4,246,976 | A | | 1/1981 | McDonald, Jr. |
| 4,324,299 | A | | 4/1982 | Nagel |
| 4,437,525 | A | | 3/1984 | O'Hanlon et al. |
| 4,440,242 | A | | 4/1984 | Schmidt et al. |
| 4,493,381 | A | | 1/1985 | Kajikawa et al. |
| 4,521,167 | A | | 6/1985 | Cavalleri et al. |
| 4,529,046 | A | | 7/1985 | Schmidt et al. |
| D285,824 | S | | 9/1986 | Anderson |
| 4,665,997 | A | | 5/1987 | Maurer et al. |
| 4,715,538 | A | | 12/1987 | Lingnau |
| 4,747,544 | A | | 5/1988 | Kranzle |
| 4,821,961 | A | * | 4/1989 | Shook ..... B05B 3/06 239/253 |
| 4,905,775 | A | | 3/1990 | Warren et al. |
| 4,923,120 | A | | 5/1990 | Hammelmann |
| 4,934,254 | A | | 6/1990 | Clark et al. |
| 5,024,382 | A | | 6/1991 | Shook et al. |
| 5,028,004 | A | | 7/1991 | Hammelmann |
| 5,096,122 | A | | 3/1992 | Abramoska |
| D327,943 | S | | 7/1992 | Tsai |
| 5,135,015 | A | | 8/1992 | Young |
| 5,195,585 | A | | 3/1993 | Clemens et al. |
| 5,217,163 | A | | 6/1993 | Henshaw |
| 5,456,413 | A | | 10/1995 | Ellis |
| 5,531,383 | A | | 7/1996 | Pacht |
| 5,603,385 | A | | 2/1997 | Colebrook |
| 5,685,487 | A | | 11/1997 | Ellis |
| 5,857,623 | A | | 1/1999 | Miller et al. |
| 5,909,848 | A | | 6/1999 | Zink |
| 5,909,879 | A | | 6/1999 | Simpson |
| 5,938,206 | A | | 8/1999 | Klosterman et al. |
| 5,964,414 | A | | 10/1999 | Hardy et al. |
| 6,027,040 | A | | 2/2000 | Frye-Hammelmann |
| 6,059,202 | A | | 5/2000 | Zink et al. |
| 6,062,311 | A | | 5/2000 | Johnson et al. |
| 6,085,994 | A | | 7/2000 | Zink |
| 6,263,969 | B1 | | 7/2001 | Stoesz et al. |
| 6,347,675 | B1 | | 2/2002 | Kollé |
| 6,453,996 | B1 | | 9/2002 | Carmichael et al. |
| 6,557,856 | B1 | | 5/2003 | Azibert et al. |
| 6,698,669 | B2 | | 3/2004 | Rieben |
| 7,198,456 | B2 | | 4/2007 | Kollé et al. |
| 7,201,238 | B2 | | 4/2007 | Marvin et al. |
| 7,546,959 | B2 | | 6/2009 | Wagner et al. |
| 7,594,614 | B2 | | 9/2009 | Vijay et al. |
| 7,635,096 | B2 | | 12/2009 | Wright et al. |
| 8,006,920 | B2 | * | 8/2011 | Wright ..... B05B 3/002 134/198 |
| 8,016,210 | B2 | | 9/2011 | Wright |
| 8,220,724 | B2 | | 7/2012 | Wright |
| 8,298,349 | B2 | | 10/2012 | Wojciechowski, III et al. |
| 8,434,696 | B2 | | 5/2013 | Wright |
| 2005/0109541 | A1 | | 5/2005 | Marvin et al. |
| 2007/0257132 | A1 | | 11/2007 | Wright et al. |
| 2010/0300498 | A1 | | 12/2010 | Wojciechowski, III et al. |

FOREIGN PATENT DOCUMENTS

| | | | |
|---|---|---|---|
| DE | 1568680 | A1 | 3/1970 |
| GB | 1119696 | | 7/1968 |
| GB | 1 568 680 | | 6/1980 |
| JP | 6171684 | A | 6/1994 |
| JP | 07155719 | A | 6/1995 |
| JP | 10211450 | A | 8/1998 |
| JP | 2000130294 | A | 5/2000 |
| SU | 587240 | A1 | 1/1978 |

OTHER PUBLICATIONS

Kollé, Jack J., Moving an Ice Mountain, Tempress Technologies, Kent, Washington, Dec. 14, 2004, pp. 1-7.

Stoneage Waterblast Tools, Waterblast Solutions 2008 Catalog, pp. 24-25, Banshee Nozzles and Banshee Head Options.

* cited by examiner

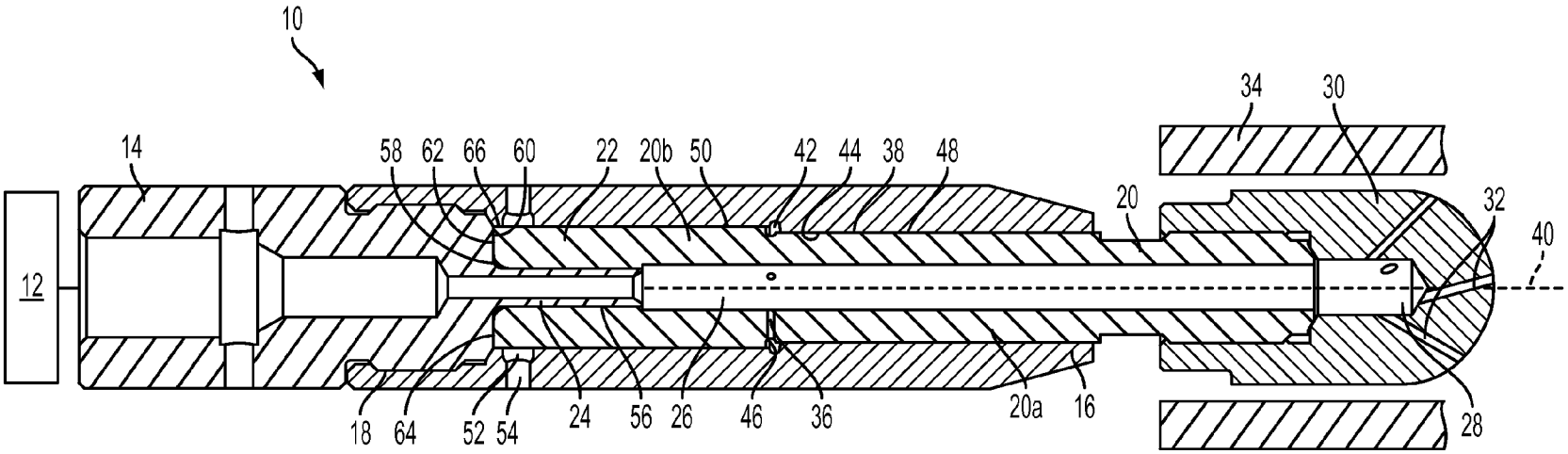
10
12
14
18
20
20a
20b
22
24
26
28
30
32
34
36
38
40
42
44
46
48
50
52
54
56
58
60
62
64
66

ROTATING FLUID NOZZLE FOR TUBE CLEANING SYSTEM

TECHNICAL FIELD

This disclosure relates to a rotating fluid nozzle for use in a tube cleaning system.

BACKGROUND

Systems utilized to clean the interior of tubes, or other small hollow parts, with the use of a high pressure water jets are known. Typically, a rotating fluid nozzle is inserted into the interior of a tube, and moved along that interior. A source of high pressure water is generally connected to the nozzle and jets outwardly from nozzle openings at a forward end of the nozzle, causing the nozzle to rotate. The jetting fluid impacts against an interior surface, cleaning the tube. One challenge with such high pressure jet nozzles is the countering of the forces on the shaft from the high pressure water.

SUMMARY

In at least one embodiment, a fluid nozzle for use in a high pressure water jetting system is provided. The nozzle may include a stationary housing configured to receive a source of high pressure water, the housing having defined therein an inner bore. A rotating member may be disposed within the inner bore, the rotating member including a shaft having an inlet end and a nozzle extending outwardly of the housing. A central passage may be defined in the shaft for communicating high pressure fluid to the nozzle, the shaft including communication passages to provide fluid from the central passage to a forward fluid pressure chamber defined between an outer peripheral surface of the shaft and the housing. A rear fluid pressure chamber may be defined between the shaft and the housing and a restriction may be defined between the housing and the inlet end of the shaft, the restriction configured to receive fluid from the rear fluid pressure chamber and transport it to a chamber communicating with the atmosphere. A volume of the restriction may be configured to decrease when the shaft moves axially forward.

The outer peripheral surface of the shaft and the housing may further define forward and rearward leakage paths extending from the forward fluid pressure chamber to allow fluid to flow to the atmosphere. The inlet end of the shaft may be configured to receive a stem of the stationary housing and the rear fluid pressure chamber may be adjacent to the stem. The rear fluid pressure chamber may be configured to receive water that has leaked between the stem and the inlet end of the shaft and transport it to opposing thrust surfaces on the housing and the shaft, thereby applying a forward force to at least partially balance a rearward force generated by the forward fluid pressure chamber.

In one embodiment, the restriction is formed as an 0.00025 to 0.0015 inch annular gap between the housing and the inlet end of the shaft. The communication passages may provide fluid directly from the central passage to the forward fluid pressure chamber. The shaft may be divided into a distal portion and a proximal portion at the communication passages and the distal and proximal portions may each have a substantially constant outer diameter and the outer diameter of the proximal portion may be greater than that of the distal portion.

In at least one embodiment, a fluid nozzle for use in a high pressure water jetting system is provided. The nozzle may include a stationary housing configured to receive a source of high pressure water, the housing having defined therein an inner bore. A rotating member may be disposed within the inner bore, the rotating member including a shaft having an inlet end and a nozzle extending outwardly of the housing. A central passage may be defined in the shaft for communicating high pressure fluid to the nozzle, the shaft including communication passages to provide fluid from the central passage to a forward fluid pressure chamber defined between an outer peripheral surface of the shaft and the housing. A rear fluid pressure chamber may be defined between the shaft and the housing and an annular restriction may be defined between the housing and the inlet end of the shaft, the restriction configured to receive fluid from the rear fluid pressure chamber and transport it to a chamber communicating with the atmosphere. A volume of the restriction may be configured to decrease when the shaft moves axially forward.

The inlet end of the shaft may be configured to receive a stem of the stationary housing and the rear fluid pressure chamber may be adjacent to the stem. The communication passages may provide fluid directly from the central passage to the forward fluid pressure chamber. In one embodiment, the shaft may be divided into a distal portion and a proximal portion at the communication passages, the distal and proximal portions each having a substantially constant outer diameter and the outer diameter of the proximal portion being greater than that of the distal portion. The rear fluid pressure chamber may be configured to receive water that has leaked between the stem and the inlet end of the shaft and transport it to opposing thrust surfaces on the housing and the shaft, thereby applying a forward force to at least partially balance a rearward force generated by the forward fluid pressure chamber. The annular restriction may be formed as an 0.00025 to 0.0015 inch annular gap between the housing and the inlet end of the shaft.

In at least one embodiment, a fluid nozzle for use in a high pressure water jetting system is provided. The nozzle may include a stationary housing configured to receive a source of high pressure water, the housing having defined therein an inner bore. A rotating member may be disposed within the inner bore, the rotating member including a shaft having an inlet end and a nozzle extending outwardly of the housing. A central passage may be defined within the shaft for communicating high pressure fluid to the nozzle, the shaft including communication passages to provide fluid from the central passage to a forward fluid pressure chamber defined between an outer peripheral surface of the shaft and the housing. A rear fluid pressure chamber may be defined between the shaft and the housing and a restriction may be defined between the housing and the inlet end of the shaft and communicating with an atmospheric chamber.

The restriction may be configured to receive fluid from the rear fluid pressure chamber and transport it to the atmospheric chamber and to decrease in volume when the shaft moves axially forward. The inlet end of the shaft may be configured to receive a stem of the stationary housing and the rear fluid pressure chamber may be adjacent to the stem. In one embodiment, the rear fluid pressure chamber is configured to receive water that has leaked between the stem and the inlet end of the shaft and transport it to opposing thrust surfaces on the housing and the shaft, thereby applying a forward force to at least partially balance a rearward force generated by the forward fluid pressure chamber. The restriction may be formed as an 0.00025 to 0.0015 inch annular gap between the housing and the inlet end of the shaft.

BRIEF DESCRIPTION OF THE DRAWINGS

FIG. 1 is a cross-section of a rotating nozzle, according to an embodiment.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

With respect to FIG. 1, a rotating nozzle head 10 is shown, which may be connected to a source of high pressure fluid 12 (e.g., up to about 55,000 psi or greater). One such source may be that disclosed in co-pending patent application Publication No. US 2010/0300498 A1 published Dec. 2, 2010 entitled "EASY CHANGE TUBE CLEANING SYSTEM," the disclosure of which is hereby incorporated in its entirety by reference herein. However, other ways of providing pressurized water to the nozzle would come within the scope of this invention. In addition, further disclosure of a rotating nozzle head is provided in U.S. Pat. No. 8,298,349, the disclosure of which is hereby incorporated in its entirety by reference herein.

A first housing 14 includes threads to be secured to a component for delivering the water. A second fixed housing 16 is connected through a thread connection 18 to the first housing 14. While the first and second housings 14 and 16 are shown as separate components, they may be connected to form a fixed, single stationary housing. A rotating shaft 20 is disposed within the second housing 16 and has an inlet end 22, which receives a stem 24 of the first housing 14. The rotating shaft 20 has a central passage 26, which may receive the high pressure fluid from the source 12 at the inlet end 22 from the stem 24. The central passage 26 communicates pressurized fluid to a nozzle chamber 28 in a nozzle 30. Fluid reaching the chamber 28 then communicates through nozzle holes or ports 32. At least one hole 32 may be configured to spray the pressurized fluid in a direction that is not parallel to the longitudinal axis of the central passage 26 (e.g., the fluid is sprayed in a direction that is either oblique or perpendicular to the longitudinal axis of the central passage 26). The fluid exiting the hole 32 may therefore exert a force that has at least a radial component. The shaft may therefore be rotated by the radial component of the fluid force exerted by fluid exiting from one or more holes 32.

As shown in FIG. 1, at least one communication passage or hole 36 extends from central passage 26 radially outwardly towards an outer peripheral surface 38 of the shaft 20. There may be a plurality of passages 36, for example, 2, 3, 4, or more passages 36. The passages 36 may be equally spaced about a longitudinal axis 40 of the central passage 26 (e.g., 120° apart in cross-section, if there are three passages 36). Fluid delivered through the passage(s) 36 reaches a forward fluid pressure chamber 42 defined between the outer peripheral surface 38 of the shaft 20 and an inner surface or bore 44 of the second housing 16. The passages or holes 36 may divide the shaft 20 into a forward or distal portion 20*a* and a rearward or proximal portion 20*b*. In at least one embodiment, the distal portion 20*a* and the proximal portion 20*b* may each have a substantially constant outer diameter along their lengths. The distal portion 20*a* may have a smaller outer diameter than the proximal portion 20*b*, such that a surface or shoulder 46 is formed where they meet (e.g., at the communication passages 36). Accordingly, the shaft 20 may generally be a hollow cylinder having a stepwise reduction in outer diameter at the communication passages 36.

The forward pressure chamber 42 may communicate directly with the passage(s) 36 (e.g., the passages 36 terminate in chamber 42 without intermediate passages, such as leakage paths). The forward pressure chamber 42 may be annular, extending around the entire circumference of the shaft 20. However, the chamber 42 may be discontinuous or broken into discrete sub-chambers. The pressure from the fluid in the forward pressure chamber 42 may act on the surface 46 (e.g., a shoulder) formed on the outer peripheral surface 38 of the shaft 20 and adjacent to the forward pressure chamber 42. The pressure on surface 46 may therefore generate a force on the shaft 20 in a direction opposite the flow of fluid (e.g., from right to left in FIG. 1). This force may at least partially counteract the inlet forces and reaction forces from the fluid jets exiting from ports 32. The inlet forces include the reaction force of the water pressure acting on the distal end of the nozzle head on an area the size of the inner diameter of the stem 24 (the inlet area).

A ratio of pressure chamber area (e.g., area of surface 46) to inlet area may be defined to at least partially control the axial force that is generated in a direction opposite the fluid direction (e.g. toward the inlet adapter). The ratio may be determined based on the desired counter force for a given nozzle design. In at least one embodiment, the ratio of pressure chamber area to inlet area may be 1.1:1 to 5:1. In another embodiment, the ratio of pressure chamber area to inlet area may be 1.2:1 to 4:1. In another embodiment, the ratio of pressure chamber area to inlet area may be 1.3:1 to 3:1. In another embodiment, the ratio of pressure chamber area to inlet area may be 1.4:1 to 2.5:1. In another embodiment, the ratio of pressure chamber area to inlet area may be 1.5:1 to 2:1.

In embodiments where the forward pressure chamber 42 communicates directly with the passage(s) 36, the pressure in the forward chamber 42 may be the same as in the central passage 26, and may not, for example, depend on a pressure drop of the fluid through an intermediate passage (e.g., a leakage path). From the forward pressure chamber 42, the fluid may travel through a forward leakage path 48 in a direction towards the nozzle 30 and ultimately to the atmosphere. The fluid from forward chamber 42 may also travel through a rearward leakage path 50 in a direction away from the nozzle 30 through a chamber 52 and ultimately to the atmosphere through an opening 54. The fluid traveling through leakage paths 48 and 50 may provide a fluid bearing between the rotating shaft 20 and the second housing 16, which may eliminate the need for mechanical bearings. The gap size of the leakage paths 48 and 50 may be half of the clearance between the second housing 16 and the shaft 20 (e.g., the diameter of the inner surface or bore 44 minus the diameter of the outer peripheral surface 38 of the shaft 20). The clearance may be configured to be as small as possible while still allowing impurities in the water to pass through. In one embodiment, the clearance may be from 0.0005 to 0.005 inches. In another embodiment, the clearance may be 0.0005 to 0.003 inches. In another embodiment, the clearance may be 0.0007 to 0.002 inches. In another embodiment, the clearance may be 0.0009 to 0.0015 inches. The gap size of the leakage paths may therefore be half of the above dimensions (e.g., 0.00025 to 0.0025 inches, 0.00025 to 0.0015 inches, 0.00035 to 0.001, or 0.00045 to 0.00075 inches).

A flow rate coefficient, $C_v$, may be defined to describe how efficiently fluid flows through a portion of the nozzle. The flow rate coefficient describes a relationship between flow rate and pressure drop, and is defined as $C_v=F/\sqrt{\Delta P}$ where F is flow rate in gallons per minute and $\Delta P$ is the pressure drop (if the fluid is not water, a specific gravity factor may also be included). A ratio of flow coefficient for the communications passages 36 and the leakage paths 48 and 50 may be defined to, for example, control the amount of fluid flowing through the leakage paths 48 and 50. If insufficient fluid flows through the leakage paths, the fluid bearing may not be effective. In at least one embodiment, the ratio of the flow coefficient in the communication passages 36 (as a whole) to the flow coefficient in the leakage paths 48 and 50 (as a whole) may be 1.1:1 to 5:1. In another embodiment, the ratio of the flow coefficient in the communication passages to the leakage paths may be 1.5:1 to 4:1. In another embodiment, the ratio of the flow coefficient in the communication passages to the leakage paths may be 2:1 to 3.5:1. In another embodiment, the ratio of the flow coefficient in the communication passages to the leakage paths may be 2:1 to 3:1.

In addition to fluid passing through communication passages 36, forward pressure chamber 42, and ultimately to the atmosphere through leakage paths 48 or 50, fluid may also flow through a stem leakage path 56 between the stem 24 of the first housing 14 and the inlet end 22 of shaft 20. This fluid may serve as a fluid bearing between the stem 24 and the shaft 20, similar to the fluid bearing described above between the shaft 20 and the second housing 16. The height of the leakage path 56 may be similar to the ranges described above for the height of leakage paths 48 and 50. The fluid flowing through the stem leakage path 56 may then enter a rear pressure chamber 58 defined between the inlet end 22 of the shaft 20 and the first housing 14 adjacent to the stem 24. The pressure from the rear pressure chamber 58 acts across the face of a ledge or shoulder 60 of the first housing 14 adjacent to the stem 24 and a rear face 62 of the shaft 20 to form a thrust bearing 64. The thrust bearing 64 may at least partially counteract the forces generated in the rearward direction by the forward pressure chamber 42. If the net force in the forward direction is greater than in the rearward direction, the shaft 20 will move axially forward, increasing the width of the thrust bearing 64 and causing the pressure to be reduced. If the net force is greater in the rearward direction, then the width of the thrust bearing 64 is reduced and the pressure is increased. After the fluid flows between the ledge 60 and rear face 62, it ultimately flows through chamber 52 and out to the atmosphere through opening 54.

A ratio of rear pressure chamber area (e.g., area of thrust bearing 64) to inlet area may be defined to at least partially control the axial force that is generated in a direction parallel to the fluid direction (e.g. toward the nozzle head). The ratio may be determined based on the desired axial force for a given nozzle design. The pressure of the fluid in the rear pressure chamber 58 may be relatively low compared to the pressure of the fluid in the forward pressure chamber 42. Therefore, the area of the thrust bearing may be relatively high in order to at least partially counter the force from the forward pressure chamber 58. In at least one embodiment, the ratio of rear pressure chamber area to inlet area may be 5:1 to 10:1. In another embodiment, the ratio of rear pressure chamber area to inlet area may be 6:1 to 9:1. In another embodiment, the ratio of rear pressure chamber area to inlet area may be 7:1 to 9:1. In another embodiment, the ratio of rear pressure chamber area to inlet area may be 7.5:1 to 9:1. In another embodiment, the ratio of rear pressure chamber area to inlet area may be 8:1 to 9:1.

In at least one embodiment, an additional restriction 66 is included in the fluid flow path between the rear pressure chamber 58 and the chamber 52. The restriction 66 may be located between the rotating shaft 20 and the stationary second housing 16. The restriction 66 may be an annular gap (e.g., similar in height to leakage paths 48, 50, and 56) between the shaft 20 and the second housing 16 located proximal to the chamber 52. If, during operation, the pressure across thrust bearing 64 overcomes the balancing force of the forward pressure chamber 42, the shaft 20 will move axially forward. As the shaft 20 moves axially forward, the length of the restriction 66 decreases, reducing a volume of the restriction 66 (and vice versa if the shaft 20 moves axially rearward). As a result, the fluid from rear pressure chamber 58 is able to escape to the atmosphere faster, reducing the pressure in rear pressure chamber 58. The shaft 20 may therefore move axially forward and rearward until the forces are balanced by the forward pressure chamber 42, rear pressure chamber 58, and restriction 66.

A ratio of flow coefficient for the restriction 66 and the stem leakage path 56 may be defined to, for example, control width of the thrust bearing 64. If the flow coefficient of the restriction 66 were too low, for example, the shaft may move axially forward and increase the width of the thrust bearing 64 to the point of potentially destabilizing the shaft. In at least one embodiment, the ratio of the flow coefficient in the restriction 66 to the flow coefficient in the stem leakage path 56 may be 5:1 to 12:1. In another embodiment, the ratio of the flow coefficient in the restriction 66 to the flow coefficient in the stem leakage path 56 may be 6:1 to 11:1. In another embodiment, the ratio of the flow coefficient in the restriction 66 to the flow coefficient in the stem leakage path 56 may be 7:1 to 10:1. In another embodiment, the ratio of the flow coefficient in the restriction 66 to the flow coefficient in the stem leakage path 56 may be 8:1 to 9.5:1.

The disclosed rotating fluid nozzle may have numerous benefits over existing nozzles. Nozzles having only a forward pressure chamber and/or a tapered or frusto-conical shaped housing and shaft may experience difficulties when they contact an obstruction in a tube. For example, when the nozzle contacts an obstruction, the shaft may move axially rearward, thereby increasing the volume of the leakage paths. An increase in leakage path volume results in a loss of pressure in the tool and therefore a reduction in cleaning power. If the leakage path volume increases, the strength of the fluid bearing is also reduced, which may reduce the stability of the shaft, cause it to become off-centered, and/or cause it to stop rotating. In nozzles having only a forward pressure chamber, there is less resistance to the shaft moving axially rearward, which may lead to the problems described above.

The disclosed fluid nozzle may mitigate or eliminate the problems described above by incorporating a rear pressure chamber 58 in addition to the forward pressure chamber 42. An additional restriction 66 may also be provided to balance the forward and rearward axial forces on the shaft 20. Rather than a tapered housing and shaft, the nozzle 10 may have a substantially cylindrical inner bore 44 in the housing 16 and a substantially cylindrical shaft 20, which may have a step reduction in diameter to form a surface 46 upon which the pressure in chamber 42 may act. By having a substantially cylindrical bore and shaft, the fluid bearing may have a constant size regardless of the axial movement of the shaft. In addition, if the nozzle contacts an obstruction and the shaft moves axially rearward, the width and volume of the thrust bearing 64 are reduced and the length and volume of the restriction 66 are increased. This causes the pressure to increase and a greater counter force is applied in the direction of the fluid flow. The nozzle may therefore maintain pressure and mitigate any decrease in cleaning power and allow the shaft to continue rotating.

In one example, the rotating nozzle 10 may have the following ratios: forward pressure chamber area to inlet area of 1.72:1; thrust bearing area to inlet area of 8.4:1; flow rate coefficient, $C_v$, of communication passages 36 to $C_v$ of the leakage paths 48 and 50 of 2.62:1; and $C_v$ of the restriction 66 to $C_v$ of the stem leakage path 56 of 8.75:1. The diametric clearance between the bore 44 and the outer peripheral surface 38 may be from 0.0009 to 0.0015 inches in this example.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A fluid nozzle for use in a high pressure water jetting system comprising:

a stationary housing configured to receive a source of high pressure water, the housing having defined therein an inner bore;

a rotating member disposed within the inner bore, the rotating member including a shaft having an inlet end and a nozzle extending outwardly of the housing;

a central passage within the shaft for communicating high pressure fluid to the nozzle, the shaft including communication passages to provide fluid from the central passage to a forward fluid pressure chamber defined between an outer peripheral surface of the shaft and the housing;

a leakage path defined between the housing and the inlet end of the shaft;

a rear fluid pressure chamber defined between the shaft and the housing and configured to receive fluid from the leakage path; and a restriction defined between the housing and the inlet end of the shaft as an annular gap, the restriction configured to receive fluid from the rear fluid pressure chamber via the leakage path, and transport it to a chamber communicating with the atmosphere, wherein a volume of the restriction is configured to decrease when the shaft moves axially forward.

2. The nozzle of claim 1, wherein the outer peripheral surface of the shaft and the housing further define forward and rearward leakage paths extending from the forward fluid pressure chamber to allow fluid to flow to the atmosphere.

3. The nozzle of claim 1, wherein the inlet end of the shaft is configured to receive a stem of the stationary housing.

4. The nozzle of claim 3, wherein the rear fluid pressure chamber is adjacent to the stem.

5. The nozzle of claim 4, wherein the rear fluid pressure chamber is configured to receive water that has leaked between the stem and the inlet end of the shaft and transport it to opposing thrust surfaces on the housing and the shaft, thereby applying a forward force to at least partially balance a rearward force generated by the forward fluid pressure chamber.

6. The nozzle of claim 1, wherein the restriction is formed as an 0.00025 to 0.0015 inch annular gap between the housing and the inlet end of the shaft.

7. The nozzle of claim 1, wherein the communication passages provide fluid directly from the central passage to the forward fluid pressure chamber.

8. The nozzle of claim 1, wherein the shaft is divided into a distal portion and a proximal portion at the communication passages.

9. The nozzle of claim 8, wherein the distal and proximal portions each have a substantially constant outer diameter and the outer diameter of the proximal portion is greater than that of the distal portion.

10. A fluid nozzle for use in a high pressure water jetting system comprising:

a stationary housing configured to receive a source of high pressure water, the housing having defined therein an inner bore;

a rotating member disposed within the inner bore, the rotating member including a shaft having an inlet end and a nozzle extending outwardly of the housing;

a central passage within the shaft for communicating high pressure fluid to the nozzle, the shaft including communication passages to provide fluid from the central passage to a forward fluid pressure chamber defined between an outer peripheral surface of the shaft and the housing;

a rear fluid pressure chamber defined between the shaft and the housing and configured to receive fluid from a leakage path defined between the housing and the inlet end of the shaft; and an annular restriction defined as a 0.00025 to 0.0015 inch gap between the housing and the inlet end of the shaft, the restriction configured to receive fluid from the rear fluid pressure chamber via the leakage path and transport it to a chamber communicating with the atmosphere, wherein a volume of the restriction is configured to decrease when the shaft moves axially forward.

11. The nozzle of claim 10, wherein the inlet end of the shaft is configured to receive a stem of the stationary housing and the rear fluid pressure chamber is adjacent to the stem.

12. The nozzle of claim 11, wherein the rear fluid pressure chamber is configured to receive water that has leaked between the stem and the inlet end of the shaft and transport it to opposing thrust surfaces on the housing and the shaft, thereby applying a forward force to at least partially balance a rearward force generated by the forward fluid pressure chamber.

13. The nozzle of claim 10, wherein the communication passages provide fluid directly from the central passage to the forward fluid pressure chamber.

14. The nozzle of claim 10, wherein the shaft is divided into a distal portion and a proximal portion at the communication passages, the distal and proximal portions each having a substantially constant outer diameter and the outer diameter of the proximal portion being greater than that of the distal portion.

15. A fluid nozzle for use in a high pressure water jetting system comprising:

a stationary housing configured to receive a source of high pressure water, the housing having defined therein an inner bore;

a rotating member disposed within the inner bore, the rotating member including a shaft having an inlet end and a nozzle extending outwardly of the housing;

a central passage within the shaft for communicating high pressure fluid to the nozzle, the shaft including communication passages to provide fluid from the central passage to a forward fluid pressure chamber defined between an outer peripheral surface of the shaft and the housing;

a leakage path defined between the housing and the inlet end of the shaft;

a rear fluid pressure chamber defined between the shaft and the housing and configured to receive fluid from the leakage path; and a restriction defined as an annular gap between the housing and the inlet end of the shaft configured to receive fluid from the rear fluid pressure chamber via the leakage path and communicating with an atmospheric chamber.

16. The nozzle of claim 15, wherein the restriction is configured to receive fluid from the rear fluid pressure chamber and transport it to the atmospheric chamber and to decrease in volume when the shaft moves axially forward.

17. The nozzle of claim 15, wherein the inlet end of the shaft is configured to receive a stem of the stationary housing and the rear fluid pressure chamber is adjacent to the stem.

18. The nozzle of claim 17, wherein the rear fluid pressure chamber is configured to receive water that has leaked between the stem and the inlet end of the shaft and transport it to opposing thrust surfaces on the housing and the shaft, thereby applying a forward force to at least partially balance a rearward force generated by the forward fluid pressure chamber.

19. The nozzle of claim 15, wherein the restriction is formed as an 0.00025 to 0.0015 inch annular gap between the housing and the inlet end of the shaft.

20. A fluid nozzle for use in a high pressure water jetting system comprising:

a stationary housing configured to receive a source of high pressure water, the housing having defined therein an inner bore;

a rotating member disposed within the inner bore, the rotating member including a shaft and a nozzle extending outwardly of the housing;

a central passage within the shaft for communicating high pressure fluid to the nozzle, the shaft including communication passages to provide fluid from the central passage to a forward fluid pressure chamber defined between an outer peripheral surface of the shaft and the housing;

a rear fluid pressure chamber defined between the shaft and the housing and configured to receive fluid from a leakage path defined between the housing and the inlet end of the shaft; and a restriction defined as an annular gap between the housing and the shaft, the restriction configured to receive fluid from the rear fluid pressure chamber via the leakage path and transport it to a chamber communicating with the atmosphere, wherein a volume of the restriction is configured to decrease when the shaft moves axially forward.

* * * * *